US005218808A

United States Patent [19]

Ardley

[11] Patent Number: 5,218,808

[45] Date of Patent: Jun. 15, 1993

[54] WOODEN SUSPENDED CEILING SYSTEM

[76] Inventor: Lorne V. Ardley, Box 1303, RR#2, Nepean, Ontario, Canada, K2C 3H1

[21] Appl. No.: 757,038

[22] Filed: Sep. 9, 1991

[51] Int. Cl.[5] ..... E04B 5/52

[52] U.S. Cl. ..... 52/484; 52/488; 52/489; 52/664; 52/665

[58] Field of Search ..... 52/483, 664, 665, 488, 52/489, 484, DIG. 8, 780

[56] References Cited

U.S. PATENT DOCUMENTS

| | | | |
|---|---|---|---|
| 738,950 | 9/1903 | Shoemaker | 52/DIG. 8 X |
| 2,252,278 | 8/1941 | Wilson et al. | 52/483 X |
| 3,158,963 | 12/1964 | DeMaison | 52/483 |
| 4,281,498 | 8/1981 | Kern | 52/665 X |
| 4,367,616 | 1/1983 | Pearson | 52/664 |
| 4,464,876 | 8/1984 | Kern | 52/484 |
| 4,541,215 | 9/1985 | Nickloy et al. | 52/DIG. 8 X |
| 4,674,254 | 6/1987 | Koehler | 52/484 |
| 4,773,200 | 9/1988 | Young | 52/664 X |
| 4,841,709 | 6/1989 | Peterson et al. | 52/664 |

*Primary Examiner*—Richard E. Chilcot, Jr.

*Assistant Examiner*—Beth Aubrey

*Attorney, Agent, or Firm*—Thomas Adams & Associates

[57] ABSTRACT

A suspended ceiling system which uses only two components to form main beams of an inverted T-shaped cross-section, cross beams of an inverted T-shaped cross-section and wall hangers of an L-shaped cross-section. A first, upright one of the components has a generally rectangular cross-section with one longitudinal edge recessed. The second component has a central groove for receiving the first component. The sides of the groove are stepped to give two steps which complement the recess edge of the first component. The first component can be fitted with its plain edge in the central groove to form an inverted T-section; with its recessed edge engaging one step to form an L-section, and with its recessed edge engaging the other step to form a J-section. The system may conveniently be sold in kit form comprising the two components and, possibly, joining members for joining cross beams to main beams. The two components may also be used to form a member with a J-shaped cross-section suitable for use in adding coves to the suspended ceiling.

15 Claims, 4 Drawing Sheets

WOODEN SUSPENDED CEILING SYSTEM

BACKGROUND OF THE INVENTION

This invention relates to a wooden suspended ceiling system, and in particular it relates to a wooden suspended ceiling system where various parts of the system may be formed from a plurality of components.

Wooden suspended ceiling systems are known. For example, U.S. Pat. No. 4,281,498-Kern, issued Aug. 4, 1981; U.S. Pat. No. 4,367,616-Pearson, issued Jan. 11, 1983; U.S. Pat. No. 4,773,200-Young, issued Sep. 27, 1988; and U.S. Pat. No. 4,841,709-Peterson et al, issued Jun. 27, 1989, all describe suspended ceiling systems which use wooden beams. Wooden beams are considered to provide a more attractive appearance than metal beams. In these prior patents, the main beams, cross beams and wall hangers are all made of wood. In the U.S. Pat. No. 4,841,709 to Peterson et al and U.S. Pat. No. 4,773,200 to Young, the main beam, the cross beam and the wall hanger are each made of a single piece of wood. The manufacture of shaped beams from a solid piece of wood tends to be wasteful, and in addition, wooden beams and other members made from a single piece of wood tend to twist and warp as the wood dries and ages. Twisting and warping will, of course, cause problems in a suspended ceiling, particularly where intercepting beams are butted.

U.S. Pat. No. 4,281,498 to Kern and U.S. Pat. No. 4,637,616 to Pearson show larger main beams made from three components. Kern shows similar main beams and cross beams made from a longitudinally extending beam centre of rectangular cross-section with a longitudinally extending side member of generally L-shaped cross-section on each side of the beam centre. The outer side of the vertical part of the side member has a longitudinal slot for receiving the edge of the beam centre to form the beam. Such a composite beam would resist the tendency to twist, but it requires three components. A separate component having an L-shaped cross-section (with no slot in the outer surface of the vertical part), is used as a wall hanger. Pearson shows a main beam having an elongated central portion with a rectangular cross-section and, on either side, a longitudinally extending side member having a generally L-shaped configuration. The vertical part of the L-shaped member has its outer side glued or otherwise fastened to each edge of the central portion to form the main beam. The L-shaped member is also used as the wall hanger. The Pearson cross beams appear to be made from a single piece of wood having a configuration similar to two back-to-back L-shaped members. However the cross beam has a smaller vertical dimension than the L-shaped members of the main beam. The main beam has three components and will reduce the tendency to twist, however it does use three components. The cross beam is an additional component and appears to be made from a single piece of wood.

SUMMARY OF THE INVENTION

The present invention requires only two components to make the main beam, the cross beam and the wall hanger. The same two components can also make a J-shaped member which, when used with one of the two principal components and with a flat strip member, will provide for the mounting of cove-shaped panels.

Because there are two components and they are mounted at right angles to one another in the main beam, the cross beam, the L-shaped wall hanger and the J-shaped member, the main beam, the cross beam, the L-shaped member and the J-shaped member all resist the tendency to twist. In addition, in accordance with this invention, only one of the components is visible in a finished suspended ceiling system. This component may be of one of the more exotic woods having a grain which gives an attractive appearance, such as oak, maple, birch, teak, cherry, and the like. The other component may be of a less expensive wood with a less attractive grain, and preferably one which in itself resists warping, such as bass wood, or the like.

The intersection of the main beam and the cross beam are, in the present invention, preferably morticed rather than butted. This also aids in resisting any twisting or warping that might occur at these joints.

The two components are very suitable for selling in kit form for use by handymen and "do-it-yourself" enthusiasts. Particular lengths of the various beams or L and J-shaped members may be prepared as required from the two components.

Because there are only two components required, considerable flexibility results. Unique configurations are possible. The spacing between main beams and between cross beams may be selected as necessary for a particular design, that is, the openings defined by the beams do not necessarily have to be 2 ft×2 ft or 2 ft×4 ft.

It is therefore an object of the invention to provide components for a wooden suspended ceiling system having a main beam, cross beam, and a wall hanger all made from the same two components.

It is another object of the invention to provide a main beam and a cross beam of an inverted T-shape, an L-shaped wall hanger, and a J-shaped member, all made from two wooden components mounted together at right angles to resist the tendency to twist.

It is yet another object of the invention to provide a suspended ceiling system where the various beams and hangers are made from two components and in which only one component is visible in the finished ceiling and may be selected from one of the more exotic woods with the other component selected from a less expensive wood.

It is still another object of the invention to provide a kit having two wooden components which may be cut to desired lengths and assembled to form particular desired lengths of main beam, cross beam, L-shaped or J-shaped members.

Accordingly there is provided a suspended ceiling system comprising, a wooden main beam and a cross beam each having a T-shaped cross-section, and a wall hanger having an L-shaped cross-section, said beams and said wall hanger being made from a first elongate upright component of generally rectangular cross-section with first and second edges, the second edge of the first component having a longitudinally extending recessed portion, and a second elongate transverse component having on a first side a central groove for receiving the first edge of the first component for forming a beam of inverted T-shaped cross-section, and adjacent at least one edge of the first side of the second component having a stepped portion adjacent to the central groove for mating engagement with the longitudinally extending recessed portion of the first component for forming said wall hanger of L-shaped cross-section.

There is also provided a kit for making a suspended ceiling having a first and a second wooden component, the first component being an elongate piece of wood with a generally rectangular cross-section having a centrally located longitudinally extending groove in one of its wider sides, both sides of the first component adjacent the groove being recessed to form two steps, the second component being an elongate piece of wood with a generally rectangular cross-section having a first flat shorter side and a second opposite shorter side stepped at the center thereof to provide a longitudinally extending recessed portion, the first side of the second component being adapted to be received into the groove in the first component to form a beam having an inverted T-shaped cross-section, the second side of the second component being adapted to be received in one of the outer step of the first component to form a wall hanger of L-shaped cross-section and the inner step of the first component to form a J-shaped component.

BRIEF DESCRIPTION OF THE DRAWINGS

Embodiments of the invention will be described, by way of example, with reference to the accompanying drawings, in which.

DESCRIPTION OF THE PREFERRED EMBODIMENTS

Figure 10:
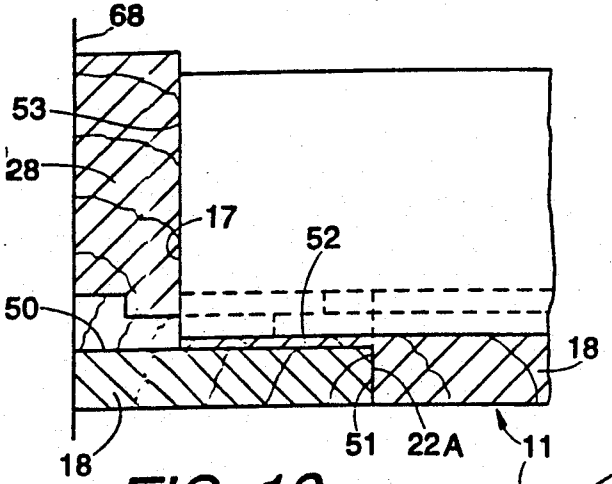
FIG. 10 is an enlarged side elevation, partly in section, of a main beam mounted to an L-shaped member as indicated by the circle in FIG. 9.
Figure 9:
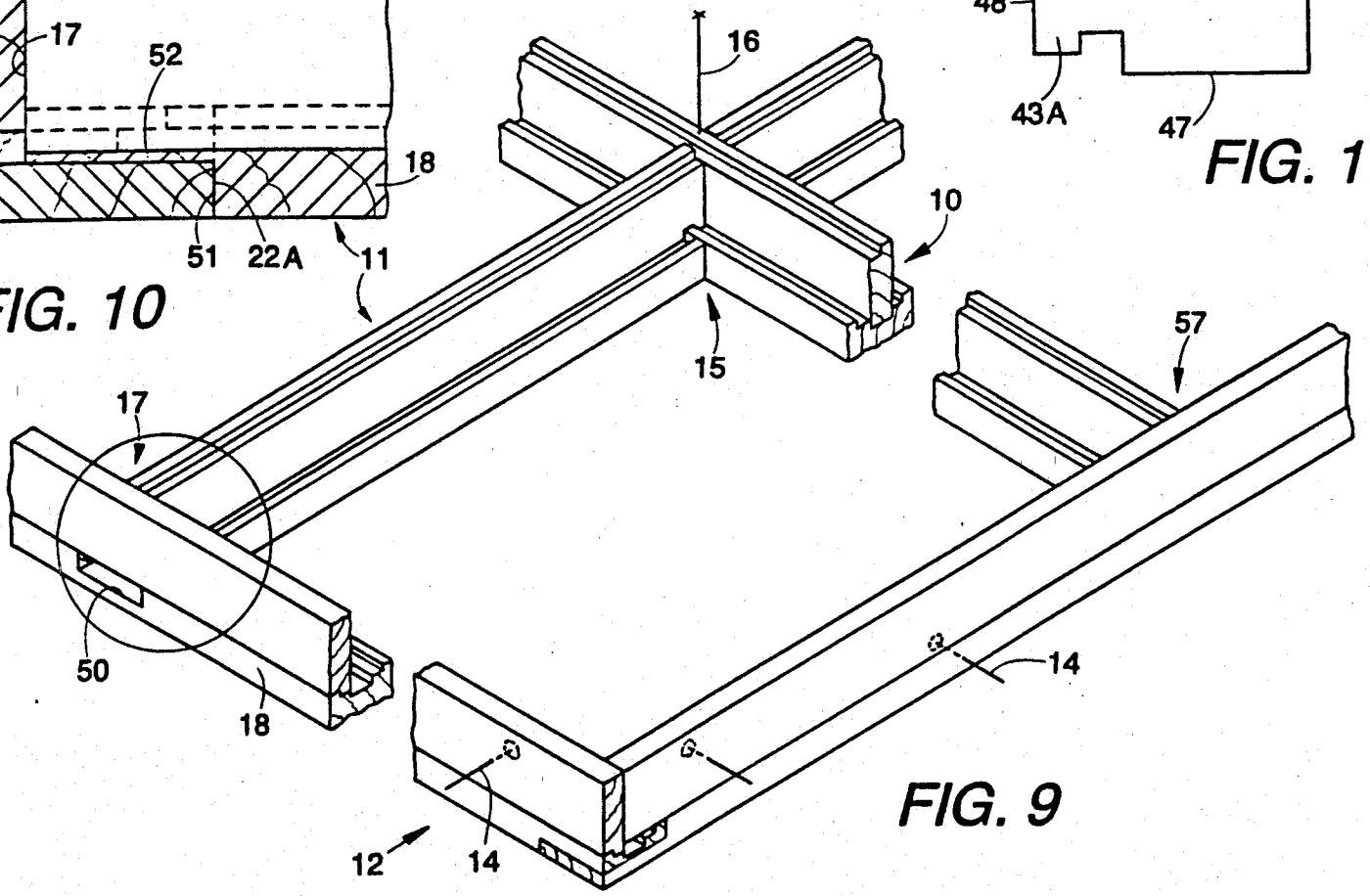
FIG. 9 is an isometric view showing part of a suspended ceiling system.

Referring briefly to FIG. 9, there is shown an isometric view of a portion of a suspended ceiling having a main beam 10 and a cross beam 11. An L-shaped wall hanger 12 is secured to each wall (not shown) by nails or screws 14. One intersection of main beam 10 and cross beam 11 is shown at 15. The beams may be supported from the ceiling or rafters (not shown) of the room or joists of the floor above, by a support 16 as is known. The ends of beams 10 and 11 are supported where they abut wall hanger 12 by the wall hanger itself. One example is shown at beam end 17 described hereinafter with reference to FIG. 10. It will be understood that there are normally a plurality of main beams 10 and cross beams 11 spaced apart to define openings of a desired size for receiving panels. The intersection 15 (as well as the support at beam end 17) will be described in more detail subsequently.

Figure 1:
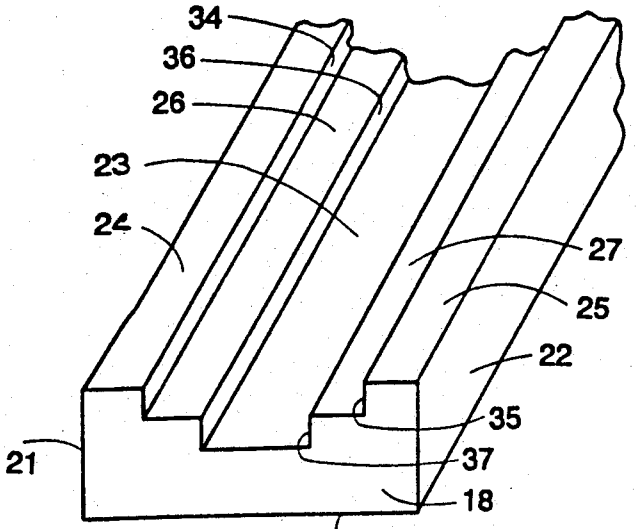
FIG. 1 is an isometric view of an end portion of one of the components of a suspended ceiling embodying the invention.

Referring now to FIG. 1, there is shown in isometric form an end view of an elongate component 18. This is sometimes referred to as the transverse component 18, and it is generally rectangular in cross-section with a bottom surface 20 and side surfaces 21 and 22. The top has a longitudinally extending, centrally located, flat bottomed groove 23 which is substantially one third of the width of transverse component 18. The top is stepped and has two lip surfaces 24 and 25 adjacent side surfaces 21 and 22 respectively. Stepped down or recessed with respect to respective lip surfaces 24 and 25 are intermediate surfaces 26 and 27 which are generally midway between surfaces 24 and 25 and the bottom surface of groove 23. The surfaces 24, 25, 26 and 27 are each substantially one sixth of the width of transverse component 18.

Figure 2:
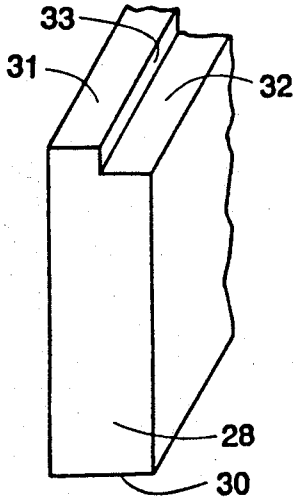
FIG. 2 is an isometric view of an end portion of another component of the suspended ceiling.

Referring now to both FIGS. 1 and 2, FIG. 2 shows an isometric view of a second elongate component 28, sometimes referred to as the upright component 28. Component 28 is generally rectangular in cross-section with a width that is just slightly less than the width of central groove 23 in component 18 so that an edge 30 of component 28 will fit snugly into groove 23. The edge of component 28 opposite edge 30 has a top surface 31 stepped along its longitudinal center line to form a longitudinally extending recessed surface 32. The widths of surfaces 31 and 32 are each approximately equal to one sixth of the width of component 18, that is, the width of surfaces 24, 25, 26 and 27, and the Width of surfaces 31 and 32 are all substantially equal. Further the distance or depth 33 between surfaces 31 and 32 is substantially equal to the distance or depth 34 between surfaces 24 and 26, the distance or depth 35 between surfaces 25 and 27, the distance or depth 36 between surfaces 26 and 23, and the distance or depth 37 between surfaces 27 and 23. This will enable the upright component 28 to be mounted on the transverse component 18 in a variety of positions as will shortly be described.

Figure 3:
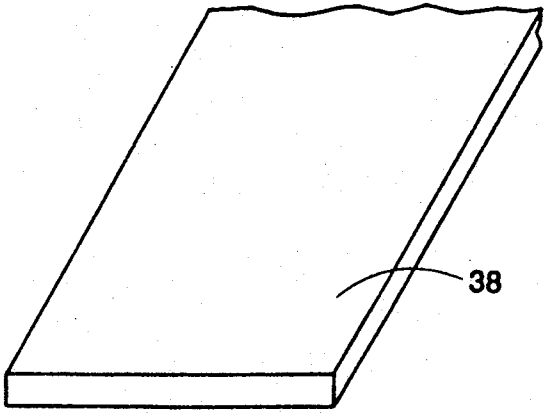
FIG. 3 is an isometric view of an end portion of another component of the invention.

Referring to FIG. 3, there is given an isometric view of another component 38. Component 38 is a flat wooden strip, substantially rectangular in cross-section and flexible. Component 38 is used only for cove mounted panels. Component 38 and the mounting of cove panels will be described subsequently with reference to FIG. 12 and 13.

Figure 4:
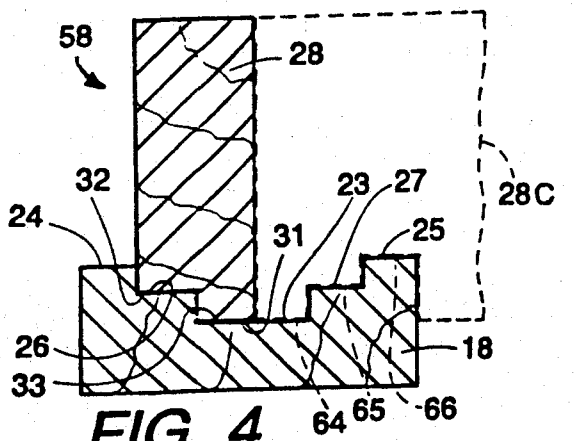
FIG. 4 is a sectional view of two components forming a J-shaped member.

Referring now to FIG. 4, there is shown a cross-section of a longitudinally extending member which will hereinafter be referred to as a J-shaped member to distinguish it from L-shaped members. It is formed from an upright component 28 and a transverse component 18. It will be seen that surfaces 31 and 32 of component 28 are in engagement with surfaces 33 and 26 respectively. The components 18 and 28 are mounted or joined to one another using a suitable adhesive, such as an epoxy adhesive.

Figure 5:
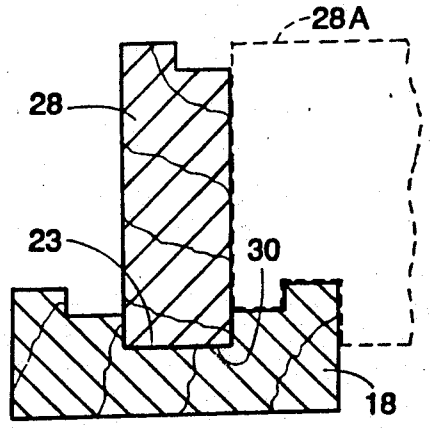
FIG. 5 is a sectional view of two components forming an inverted T-shaped member.

Referring to FIG. 5, there is shown a cross-section of an inverted T-shaped member formed from an upright component 28 and a transverse component 18. It will be seen that edge 30 of component 28 is in engagement with central groove 23 of component 18. The components 18 and 28 are mounted or joined to one another using a suitable adhesive, such as an epoxy adhesive.

Figure 6:
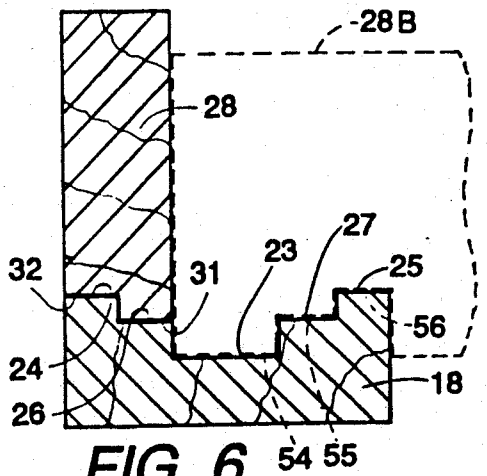
FIG. 6 is a sectional view of two components forming an L-shaped member.

Referring now to FIG. 6, there is shown a cross-section of an L-shaped member formed from an upright component 28 and a transverse component 18. It will be seen that surfaces 31 and 32 of component 28 are in respective engagement with surfaces 26 and 24 of component 18. The components 18 and 28 are mounted or joined to one another using a suitable adhesive, such as an epoxy adhesive.

Figure 7A:
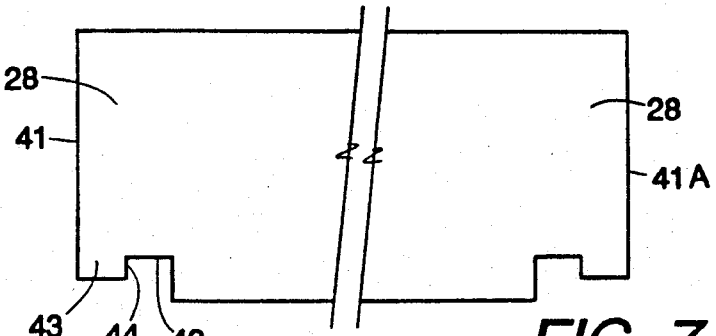
FIG. 7A is a side elevation of an upright component joining end.
Figure 8:
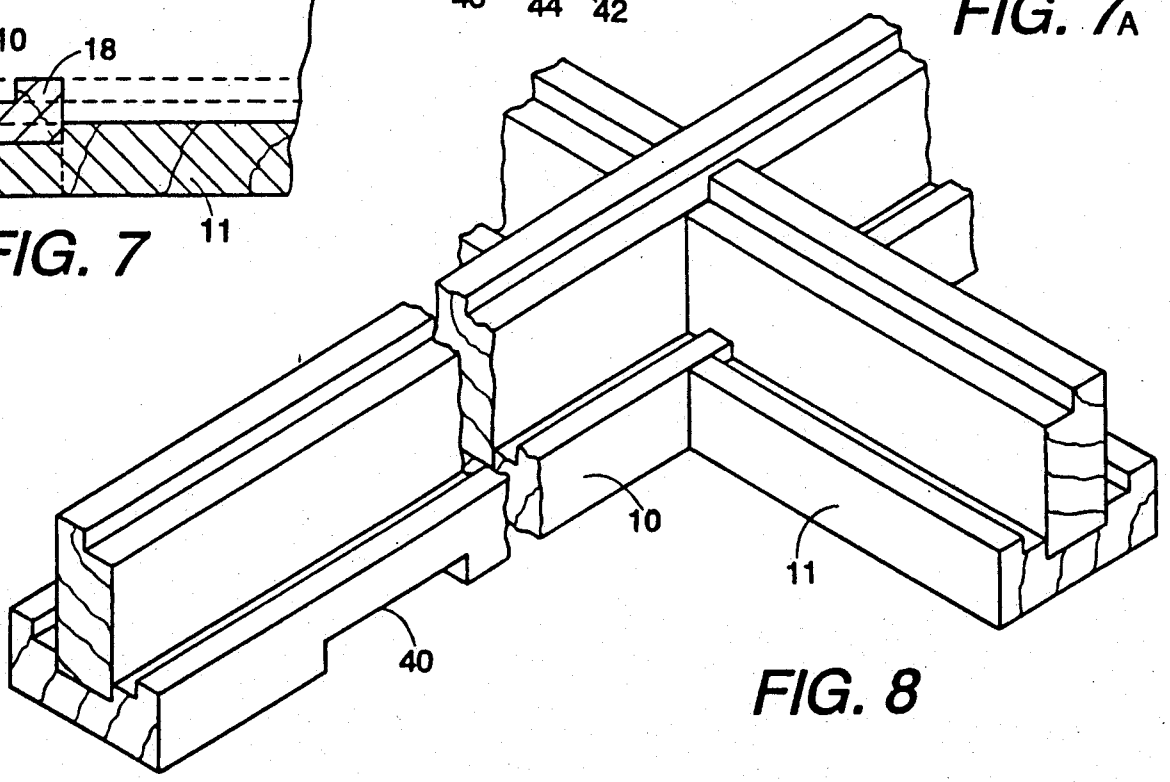
FIG. 8 is an isometric view showing the intersection of a main beam and a cross beam.
Figure 7:
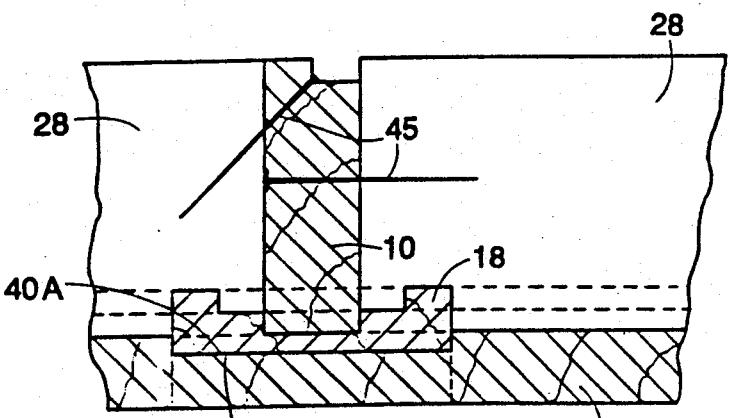
FIG. 7 is a side elevation partly in section, of a joint or intersection between a main beam and a cross beam.

Referring now to FIGS. 7 and 8, there is shown in FIG. 7 an elevation of a main beam 10 and a cross beam 11. Both the main beam 10 and the cross beam 11 have a similar inverted T-shaped cross-section (see FIG. 5). As shown, the main beam 10 has a groove or rabbet 40 extending across the bottom of the transverse component 18. In FIG. 8, a rabbet or groove 40 is shown in main beam 10 as it would appear before a cross beam 11 is in place.

Referring still to both FIGS. 7 and 8, the cross beam 11 also is cut away as to mate with the main beam 10 at rabbet 40. The transverse component 18 of cross beam 11 would therefore be cut away from the top to a depth extending below the groove 23 as indicated by 40A in FIG. 7. The bottom surfaces 20 of both the main beam 10 and cross beam 11 will then be flush at the intersection when they are assembled. It will be apparent that the upright component 28 of the cross beam 11 as shown in FIGS. 7 and 8 extend over the cut away portion of the transverse portion 18 of cross beam 11, and consequently the cross beam 11 is not assembled at this time, that is the upright component 28 and the transverse component 18 are not assembled or secured together until the cross beam 11 is installed on main beam 10. Each end 41 and 41A of upright component 28 of cross beam 11 is notched at the bottom corner as seen best in FIG. 7A. It is also indicated by broken lines in FIG. 5 as upright component 28A. A notch 42 extends across upright component 28. The groove or notch 42 is of a width to receive lip surface 24 or 25. The width of the remaining rectangular projection 43 is just less than the width of intermediate surface 26 or 27. The depth 44 of projection 43 with respect to the surface of the notch or groove 42 is substantially equal to depth 34 or 35 of transverse component 18. As shown in FIG. 7, the joint is made by assembling the upright members 28 with their end portions hooked into the grooves in the main beam 18 and secured by screws or nails 45. The transverse component 18 of cross beam 11 is then glued into place as shown and the upright component 28 of cross beam is mounted to the transverse component 18 of the cross beam 11 using a suitable glue or adhesive. The projection 43 extends into the space between the upright component 28 and the surface provided by depth 35 in transverse component 18 of main beam 10.

Figure 11:
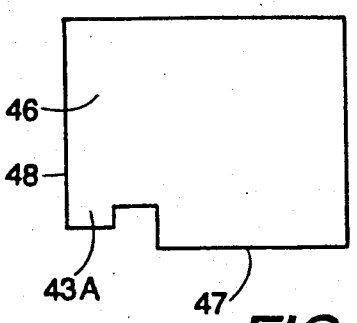
FIG. 11 is a side view of a separate joining member.

As an alternative, the ends of the upright component could be cut off flush with the end of the transverse component and a separate "end portion" joining member 46, as shown in FIG. 11, used to make the joint. This would allow the upright component and transverse component of the cross beam to be preassembled. Thus after mounting a cross beam to a main beam, the joining member 46 may be mounted to upright component 28 of a cross beam at an intersection 15, with the bottom 47 of the joining member 46 against intermediate surface 27 (or 26, depending on the side) and the end 48 against a side of upright component 28. As before, the projection 43A would extend into the groove between upright component 28 of main beam 10 and the upright surface defined by depth 34 or 35 of main beam 10.

It is preferred to mount or secure the joining member 46 using a suitable adhesive, although staples, nails or screws may be used alone or in conjunction with an adhesive. It will be apparent that one, two, three or four joining members can be used at each intersection 15, depending on the desired strength of the intersection, that is, there may be a pair of joining members 46 on each side of the upright component 28 on one side of main beam 10, and another pair on the other side of main beam 10.

FIG. 9 is an isometric view showing an intersection 15 and showing beams joined to wall hangers. The intersection 15 has already been described with reference to FIGS. 7 and 8. The L-shaped wall hanger 12 has a rabbet or a slot 50 cut through the transverse component 18 from one side to the other. This is similar to the groove cut in the cross beam 11 at intersection 15 as described with reference to FIGS. 7 and 8. Also the end of transverse component 18 of cross beam 11 is rabbetted so that end 51 of the rabbet butts against surface 22A of transverse component 18 of wall hanger 12. The remaining portion or projecting position 52 of transverse component 18 of cross beam 11 extends along the rabbet or slot 50. The end 53 of the upright component 28 of cross beam 11 is notched or grooved to hook into or fit into the transverse component 18 of wall hanger 12. This is perhaps best indicated by the upright component 28B shown in FIG. 6 by broken lines where a projecting end 54 fits into groove 23, edge 55 butts against surface 27, and notched surface 56 buts against surface 25. As before, the upright component 28 of cross beam 11 is mounted to the transverse component 18 of cross beam 11 (preferably using an adhesive) after the transverse component 18 has been cut and fastened to wall hanger 12.

An alternative, which permits the cross beam 11 to be preassembled, uses a joining member (of the same type as joining member 46 of FIG. 11 but with appropriate notches for an L-shaped wall hanger). Once the projection 52 is mounted in place, a suitable joining member is placed against the upright component 28 of cross beam 11 with projection similar to projecting end 54 (FIG. 6) extending into groove 23 and a surface similar to edge 55 against intermediate surface 27, the joining member is secured using a suitable adhesive, or using staples, nails or screws, or using a combination of such fastening means. The cross beam 11 will then be secured and supported at beam end 17. It will be understood that two joining members could be used at beam end 17, if desired—one on each side of upright component 28. Similarly, the end 57 of main beam 10 is secured to wall hanger 12 using at least one joining member 43.

It is often desirable to provide a cove at or adjacent to the edge of a suspended ceiling, or to use a cove to form a dome in a suspended ceiling. The cove or curved portion may comprise curved or flexible panels. The present invention is suitable for making coves as will be described with reference to FIGS. 12 and 13.

Figure 12:
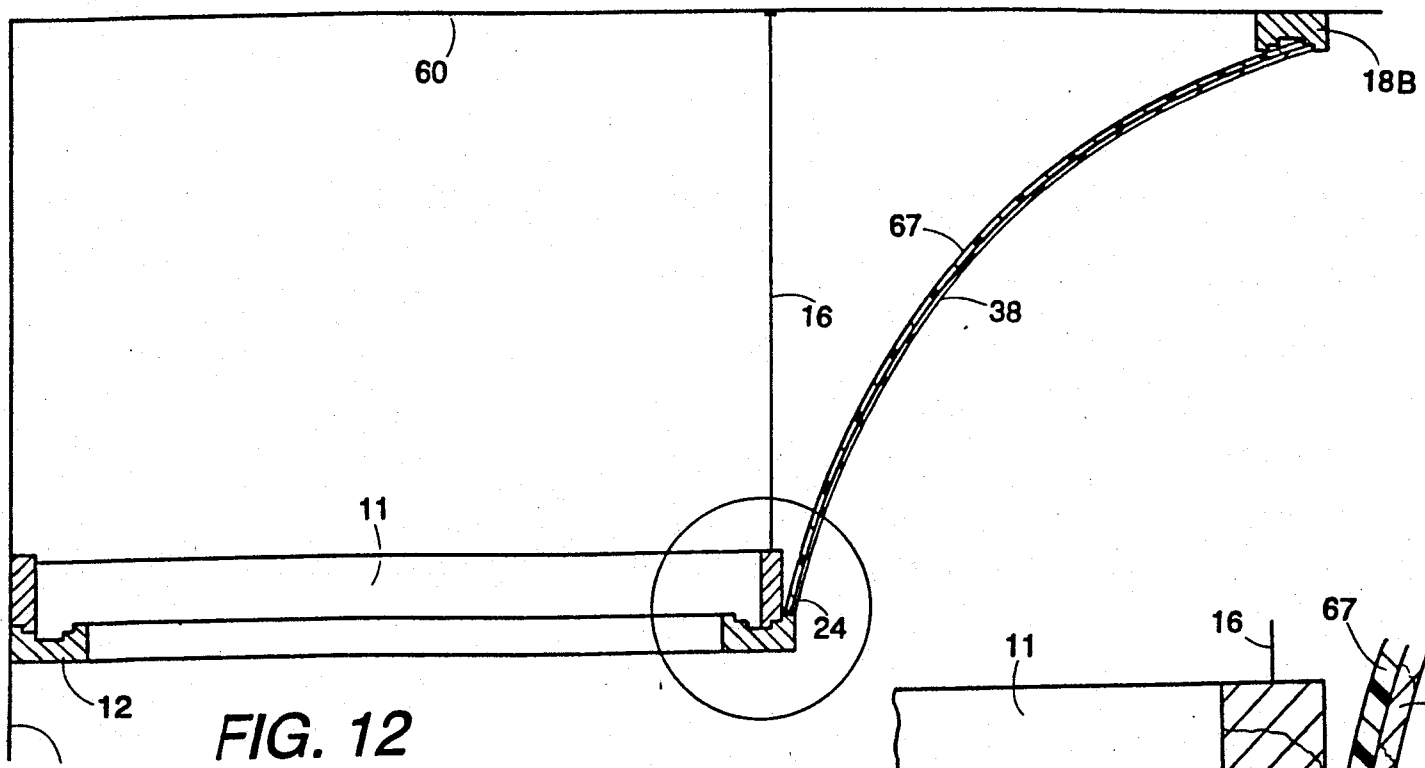
FIG. 12 is a side elevation, partly in section, of part of a suspended ceiling with a cove portion.
Figure 13:
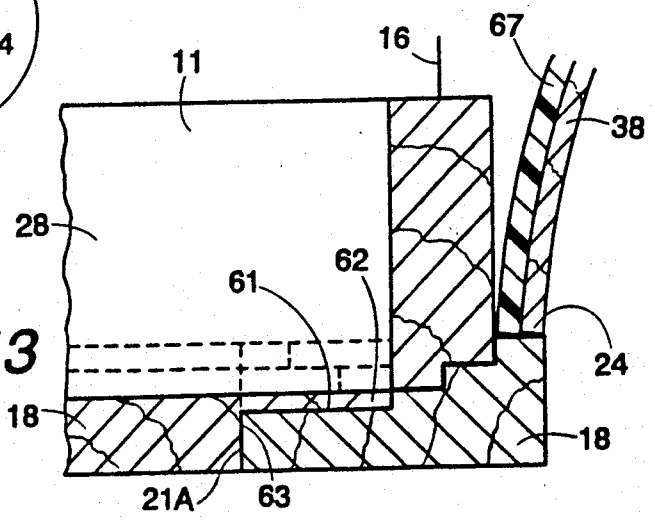
FIG. 13 is an enlarged side view, partly in section, of a J-shaped member showing a cove support, as indicated by the circle in FIG. 12.

Referring to FIG. 12, there is shown a side elevation, partly in section, of a cove. As before, a wall hanger 12, having an L-shaped cross-section, is mounted to a wall 68. Instead of being mounted to a wall 68, it could be mounted to further sections of a suspended ceiling. A cross beam 11 is secured at one end to wall hanger 12 as previously described. There is a J-shaped member or cornice 58 (see FIG. 4) at the other end of cross beam 11, supported by one or more supports 16 connected to ceiling 60. This other end of cross beam 11 is secured to the J-shaped member or cornice 58 by suitably notching the end of the upright component. This will be described in more detail with reference to FIG. 13 which shows an enlarged view of the joint between cross member 11 and J-shaped member 58. The transverse component 18 of the J-shaped member 58 is rabbetted part way across to provide a groove 61. The end of transverse component 18 of cross beam 11 is correspondingly rabbetted to mate. The projecting end 62 of transverse component 18 of cross beam 11 extends into the groove or rabbet on the top of transverse component 18 of J-shaped member 58 with end 63 of transverse component 18 of cross beam 11 butting against surface 21A of transverse component 18 of J-shaped member 58. The end of the upright component 28 of cross beam 11 is suitably notched or grooved as is best seen by component 28C shown in broken lines in FIG. 4.

The upright component 28C in FIG. 4 has a projecting portion 64 which extends into that portion of groove 23 adjacent upright component 28. The upright component 28C has a surface 65 which bears against surface 27 of transverse component 18, and a surface 66 which bears against surface 25 of transverse component 18. Thus the upright component 28C fits or hooks into the grooves in transverse member 18 and when glued in position makes a secure joint.

Referring again to FIGS. 12 and 13, the transverse component 18 of cross beam 11 is fastened to J-shaped member 58 using an adhesive or nails or both. The upright component 28 of cross beam 11 is then mounted to the transverse component 18 to complete the mounting of the beams and the cornice or J-shaped member 58.

A transverse component 18B is mounted to ceiling 60 using staples, nails or screws. A flexible panel 67 is bent and fitted into position with a lower edge bearing against lip surface 24 and the adjacent surface of upright component 28, and the upper edge bearing against the vertical part of transverse component 18B between lip surface 26 and groove 23. A covering strip, that is, component 38 (FIG. 3), is positioned in the same manner over the junction between two of the flexible panels 67 to complete the installation. The lower edge of component 38 bears against lip surface 24 and the upper edge against the vertical surface between lip surface 26 and lip surface 24.

An advantage of the separate joining members shown in FIG. 11, is that they can be mass produced beforehand which allows the notching to be done with precision.

It will be apparent that the invention may be conveniently sold in kit form. The upright and transverse components may be packaged, and the purchaser or user may make from these two components desired lengths of main beam, cross beam, L-shaped wall hanger or J-shaped members. If coves are required, then flexible cross strips (component 38, FIG. 3) may also be purchased. The user must secure the components together to form the desired parts, must cut them to length and must provide rabbits and cut away portions at intersections. The kit may, of course, include instructions for assembling a suspended ceiling in the manner described herein.

It is believed the preceding description adequately describes the invention.

I claim:

1. A suspended ceiling system comprising, a wooden main beam and a wooden cross beam, each having a T-shaped cross-section, and a wall hanger having an L-shaped cross-section, said main beam and cross beam each comprising an elongate upright component and an elongate transverse component, said elongate upright component being of generally rectangular cross-section with a first edge and a second edge, said second edge of said elongate upright component having a longitudinally extending recessed portion, said elongate transverse component having a first side, a central longitudinally extending groove in said first side receiving said first edge of said elongate upright component thereby forming a beam of inverted T-shaped cross-section, said elongate transverse component having a stepped portion adjacent at least one edge of said first side for mating engagement with a said longitudinally extending recessed portion of a said elongate upright component to form a said L-shaped cross-section.

2. A suspended ceiling system as claimed in claim 1, wherein an end portion of said elongate upright component has a notch in its lower face and a depending lug between said notch and an adjacent end of said elongate upright portion, respective lengths of the notch and lug corresponding to the size of said stepped portion whereby said end portion can be hooked onto a said stepped portion of a said second component of a beam extending transversely thereto.

3. A suspended ceiling system as defined in claim 1, further comprising a joining member joining a cross beam to a main beam, an edge portion of said joining member having a notch adjacent an end of said joining member and a lug between the notch and said adjacent end, respective lengths of said notch and said lug corresponding to the size of said stepped portion such that said joining member can be attached to said cross beam and hooked into a said stepped portion of a said elongate transverse component of said main beam.

4. A suspended ceiling system as defined in claim 1, in which said elongate upright component and said elongate transverse component of a said beam are secured together by an adhesive.

5. A suspended ceiling system as defined in claim 1, in which said elongate transverse component is of an exotic grained wood and said elongate upright component is of a wood having a less pronounced grain.

6. A suspended ceiling system comprising, a wall hanger having an L-shaped cross-section and made from a first wooden component and a second wooden component for mounting on a wall with said first wooden component adjacent the wall and second wooden component extending away from the wall to form an inwardly projecting supporting portion, a plurality of main beams extending in a first direction and a plurality of cross beams extending in a second direction at an angle to said first direction, said main beams and cross beams intersecting to define a plurality of panel receiving openings, said main beams and said cross beams each comprising a said first wooden component and a said second wooden component forming a beam having an inverted T-shaped section, opposite edge portions of said second wooden component comprising respective side arms of the inverted T cross-section and providing respective supporting lips, at least one of a said main beam and an intersecting said cross beam having a series of rabbets in a lower face thereof at intervals corresponding to one dimension of said panel receiving openings, each rabbet of a width slightly greater than the width of a said second component, the other of a said main beam and an intersecting cross beam having a series of notches in an upper face thereof at intervals corresponding to another dimension of said opening, each of said series of notches extending across the beam and of a width slightly greater than the width of a said second component, a rabbet of said at least one of the beams extending in the first direction and a notch of said at least one of the beams extending in the second direction coinciding at their intersection such that respective lower surfaces of said main beam and said cross beam are substantially coplanar.

7. A suspended ceiling system as defined in claim 6 in which respective ends of said main beams and said cross beams are supported by said inwardly projecting supporting portion of said wall hanger, said second component of said wall hanger having a supporting lip at its inwardly terminating edge and a recessed portion between said lip and said first component, and a joining member attached to each of said respective ends of the beams, each said joining member extending over and engaging said supporting lip and extending into said recessed portion.

8. A suspended ceiling as defined in claim 6 in which respective ends of said main beams and cross beams are supported by said inwardly projecting supporting portion of said wall hanger, said second component of said wall hanger has a supporting lip at its inwardly terminating edge and a recessed portion between said lip and said first component, each second component of said beam to be supported having at an end thereof a rabbet extending across its lower surface leaving a projecting part, said second component of said wall hanger being slotted for receiving said projecting part, the first component of said beam being notched at its end for engaging said supporting lip and recessed portion of said second component of said wall hanger.

9. A suspended ceiling system as defined in claim 7 in which said joining member is of wood and is secured to said first component of said beam with an adhesive.

10. A suspended ceiling structure having a wall hanger with an L-shaped cross-section and a main beam and a cross beam each with an inverted T-shaped cross-section, said wall hanger, said main beam and said cross beam each comprising a first component and a second wooden component, said first component extending longitudinally and having a generally rectangular cross-section with a base, opposed parallel sides and a recessed top, said recessed top having first flat surfaces adjacent each of said parallel sides and each extending inwardly a first distance substantially equal to one sixth of the distance between said parallel sides, second flat surfaces each adjacent a respective first flat surface and recessed towards said base by a first predetermined depth, said second flat surfaces each extending inwardly towards one another by a second distance equal to said first distance, and a central flat surface between said second flat surfaces and recessed towards said base by a second predetermined depth substantially equal to said first predetermined depth and forming a central recess of a width substantially equal to one third of the distance between said parallel sides, said second wooden component extending longitudinally and having a generally rectangular cross-section with a first flat end and a width between its longer sides just less than the width of said central recess, said first flat end being received in said central recess forming said beam with an inverted T-shaped cross-section, a second end of said generally rectangular cross-section of said second wooden component having a first flat surface portion extending approximately to the centre of said second end and a second flat portion recessed with respect to said first flat portion by a distance substantially equal to said first predetermined depth, said second end of said second wooden component engaging said first component with said first flat surface of said second wooden component against one of said second flat surfaces of said first component and said second flat surface of said second wooden component against a respective one of said first flat surfaces of said first component forming said wall hanger with its L-shaped cross-section.

11. A suspended ceiling structure as defined in claim 10 in which said first component is of an exotic wood to provide a good finished appearance and said second wooden component is of a less expensive wood.

12. A suspended ceiling structure as defined in claim 10 in which said first component and said second wooden component are fastened together using an adhesive.

13. A kit for making a suspended ceiling having a first component and a second wooden component, said first component being an elongate piece of wood with a generally rectangular cross-section having a central longitudinal groove in one of its wider sides for receiving an edge of said second component, each side of said groove being recessed to form two steps, said second component being an elongate piece of wood with a generally rectangular cross-section having a first flat shorter side and a second shorter side stepped at its center to provide a longitudinally extending recessed portion, said first flat shorter side of said second component being adapted to fit into said groove of said first component to form a beam having an inverted T-shaped cross-section and said second shorter side of said second component being adapted to fit either the outer one of said two steps of said first component to form a wall hanger with an L-shaped cross-section, or the inner one of said steps of said first component to form a substantially J-shaped component with a lip along its upright face.

14. A kit as claimed in claim 13, wherein an end portion of said second component has a notch in its lower face so as to form a depending lug at its end, respective lengths of said notch and lug corresponding to the width of said steps, whereby said end portion can be hooked onto a first component extending transversely thereto.

15. A kit as claimed in claim 13, further comprising a joining member for joining a said cross beam to a said main beam, an edge portion of said joining member having a notch in one edge, so as to form a lug between the notch and an end of said joining member, respective lengths of said notch and said lug corresponding to the width of said steps, such that said joining member can be attached to said cross beam and hooked into a said first component of said main beam.

* * * * *